US005674336A

United States Patent [19]

Coe

[11] Patent Number: 5,674,336

[45] Date of Patent: Oct. 7, 1997

[54] METHOD OF INSTALLING A FULLY ADHERED ROOFING MEMBRANE

[76] Inventor: William B. Coe, 3920 Balcom Rd., San Jose, Calif. 95148

[21] Appl. No.: 330,964

[22] Filed: Oct. 28, 1994

[51] Int. Cl.[6] ..... E04B 7/00

[52] U.S. Cl. ..... 156/71; 156/305; 264/35; 264/273

[58] Field of Search ..... 156/71, 305; 264/35, 264/273, 279.1; 427/186, 421

[56] References Cited

U.S. PATENT DOCUMENTS

| | | | |
|---|---|---|---|
| 1,619,570 | 3/1927 | Duchemin | 264/35 |
| 3,289,371 | 12/1966 | Pearson | 264/35 |
| 4,212,913 | 7/1980 | Auten | 428/251 |
| 4,668,315 | 5/1987 | Brady | 156/71 |
| 4,837,095 | 6/1989 | Hageman | 156/71 |
| 5,401,449 | 3/1995 | Hill | 264/273 |

FOREIGN PATENT DOCUMENTS

| | | |
|---|---|---|
| 0 573 366 A1 | 12/1993 | France . |
| 3521419 | 12/1986 | Germany . |
| WO/89/08135 | 9/1989 | WIPO . |

OTHER PUBLICATIONS

Product Brochure: "Rapid Ply," Conklin Company, Inc. © 1988.

Product Brochure: "Burmastic Cold Process Built-up Roofing System," TREMCO Roofing, © 1984.

*Primary Examiner*—Daniel Stemmer

*Attorney, Agent, or Firm*—Flehr Hohbach Test Albritton & Herbert LLP; William S. Galliani

[57] ABSTRACT

A method of installing an impervious barrier onto a roof is described. A reinforcement textile is initially applied to a roof substrate. Thereafter, an elastomer composition is sprayed onto the reinforcement textile. The deposited elastomer composition lifts the reinforcement textile from the roof substrate and embeds it into the elastomer composition, leaving no visible sign of the reinforcement textile. The processing steps are the opposite of those of the prior art. The processing is possible in view of the characteristics of the disclosed reinforcement textile, the elastomer composition, and the conditions under which the elastomer composition is applied to the reinforcement textile.

10 Claims, 2 Drawing Sheets

METHOD OF INSTALLING A FULLY ADHERED ROOFING MEMBRANE

BRIEF DESCRIPTION OF THE INVENTION

This invention relates generally to techniques for installing impervious barrier devices on roofs. More particularly, this invention relates to a method of installing a fully adhered roofing membrane by applying a liquid elastomer to a pre-installed reinforcement textile positioned on a roof substrate.

BACKGROUND OF THE INVENTION

Approximately four billion square feet of low slope roofing membrane material is installed every year in the United States. The majority of the roofing membrane material is applied to commercial and industrial roofs. Roofing material may also be applied to such structures as hazardous material storage facilities, domestic water vessels, and aqueducts. Generally, there are three types of installed roofing membrane materials: ballasted, mechanically fastened, and fully adhered. This invention is directed toward fully adhered roofing membrane materials.

A fully adhered roofing membrane material may, as a primary method, be applied by spraying a resin (also called an elastomer) onto a roofing substrate. Thereafter, a woven reinforcement textile is rolled over the resin to provide membrane structural integrity. Different physical devices are then used to mechanically embed the reinforcement textile within the resin. Thereafter, the resin cures to form, at least temporarily, an impervious barrier.

A prevalent problem with fully adhered roofing membrane materials is the formation of voids. Voids are weak points in the membrane that eliminate the impervious barrier of the membrane and thereby produce a premature failure within a roofing system. Voids trap moisture-laden air that eventually expands from heat to produce a blister. The blister-formation process is accelerated as the roof surface becomes darkened with age and dirt build-up. Once a blister is formed, it is easily punctured, thereby exposing the roofing substrate to all weather conditions and imminent damage.

Voids typically form over irregularities in the roofing substrate. Voids also stem from applicator errors during adhesive installation. Applicator errors include uneven spread and/or insufficient adhesive coverage. It is difficult to identify these applicator errors in adhesive application because of the minimal visual information provided during an installation process. Careful attention to workmanship during installation by brooming or mechanically pressing the reinforcement textile into the resin helps to reduce the number of deficiencies. However, this approach is labor-intensive, and therefore expensive. It would be highly desirable to provide a roofing membrane installation process that provides visual feedback information regarding possible application errors. Such a process would reduce labor costs and produce a roofing membrane that is less prone to defects.

Voids are not easily detectable. Even when detected, voids are not easily repaired. Consequently, voids lead to premature membrane failure at an estimated average of 55% of projected useful life in nearly 40% of all fully adhered roof membrane installations. Therefore, it would be desirable to provide a technique for installing a more durable roofing membrane that is not susceptible to void formation. Of course, such a roofing membrane must comply will all relevant building standards. In addition, it would be desirable if such a roofing membrane was environmentally benign and energy efficient.

Applicant is not aware of prior art attempts to reverse the roofing membrane installation process such that a pre-positioned reinforcement textile on a roof substrate is lifted and embedded in an elastomer composition in response to an elastomer spraying operation.

There are a number of practical considerations that preclude such an approach. For example, whenever a pressurized stream of fluid is forced through the air, it entrains some of the air. Additional air is entrained in the stream of fluid as it is forced through the reinforcement textile. Consequently, the use of conventional resins and textiles results in the introduction of millions of defect producing air bubbles which form and ultimately become trapped within the cured membrane. Thus, it would be desirable to eliminate the air entrainment problem that precludes pre-positioning of a reinforcement textile.

Another problem with this approach is that the resin buries the reinforcement textile, instead of flowing around and equally embracing all surfaces of the textile. Thus, to use a pre-positioned reinforcement textile in a roofing membrane, it is necessary to develop specific bulk properties in the reinforcement textile such that the reinforcement textile centers itself after the application of a resin.

Still another obstacle to this proposed approach is the realization of a high solids adhesive content composition that still has sufficient viscosity for spraying and favorable interaction with the reinforcement textile. Compliance with roof membrane building standards requires that at least a 50% solids content exist in a pre-cured roofing substrate adhesive/water proofing material. This relatively high solids content mitigates against viscosity values that permit useful interaction with a pre-installed reinforcement textile.

SUMMARY OF THE INVENTION

The invention is a method of installing an impervious barrier onto a roof. A reinforcement textile is initially applied to a roof substrate. Thereafter, an elastomer composition is sprayed onto the reinforcement textile. The deposited elastomer composition lifts the reinforcement textile from the roof substrate and embeds it into the elastomer composition, leaving no visible sign of the reinforcement textile. The processing steps are the opposite of those of the prior art. The processing is possible in view of the characteristics of the disclosed reinforcement textile, the elastomer composition, and the conditions under which the elastomer composition is applied to the reinforcement textile.

The invention is advantageous because it is relatively easy to install the reinforcement textile before the elastomer composition is applied. Applying the elastomer composition after the reinforcement textile has been installed allows visual feedback regarding the amount of elastomer composition coverage. If an insufficient amount of elastomer has been applied, openings in the reinforcement textile, appearing as "windows", are visible through the fluidized elastomer coating. This provides a visual indication to the spray technician that more elastomer is required. This type of information allows a technician with limited training to execute the process of the invention. This information also reduces the possibility of latent defects that result in long term maintenance problems.

The process of the invention uses an elastomer composition that is a waterborne liquid adhesive/waterproofing elastomeric material. The material has a sufficiently high stored viscosity to assure homogeneous suspension, and a sufficiently low viscosity at the time of installation to permit proper interaction with the pre-installed reinforcement textile. The chemistry of the elastomer also contributes to an acceptable centering of the reinforcement textile within the final adhered roofing membrane. The disclosed elastomer chemistry also solves the air entrainment problem that would otherwise prevent utilization of this technology.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION OF THE INVENTION

Figure 1:
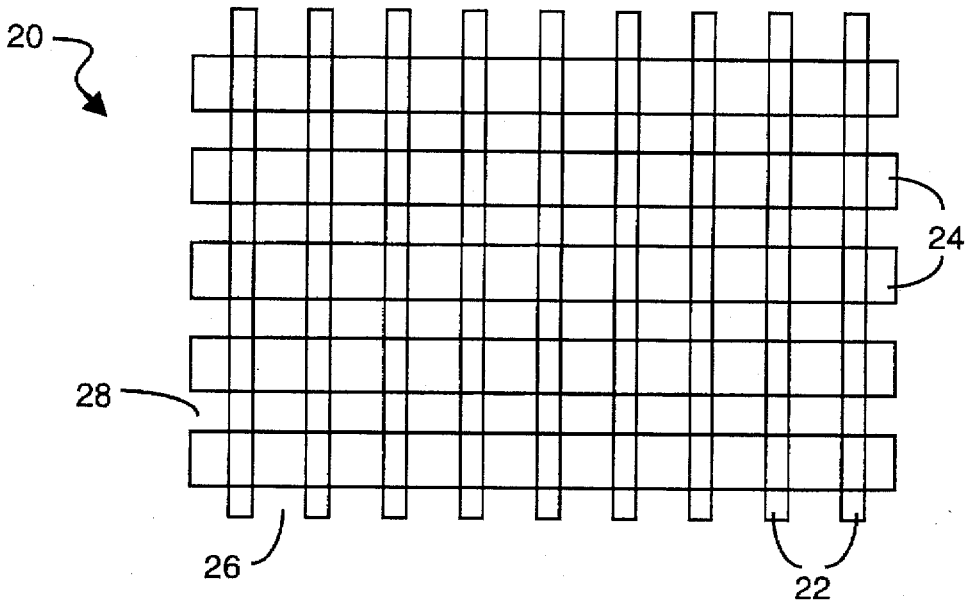
FIG. 1 is a plan view of a reinforcement textile that may be used in accordance with the invention.

The present invention is directed toward a novel method of installing a fully adhered roofing membrane. The method of the invention reverses the conventional steps associated with the installation of a roofing membrane. That is, with the present invention, a novel reinforcement textile, referred to herein as a scrim, is pre-installed on a roofing substrate. Thereafter, a novel elastomer composition is applied to the pre-installed scrim. As will be described below, the method of the invention has identified an appropriate chemical composition/solids content/viscosity relationship for the elastomer composition that permits the automatic centering of the scrim at an appropriate location within the elastomer. Moreover, if the elastomer application is insufficient, the scrim openings are visible, thereby indicating the need for additional elastomer. This visual feedback facilitates a reduction in defects. In addition, it reduces labor costs since even an untrained laborer can identify scrim break through in the elastomer. The disclosed elastomer composition avoids the prior art problem of voids due to incomplete embedment of the scrim. The resultant roofing membrane complies with all building standards, it is energy efficient, and it is environmentally benign.

The precise nature of the invention and its benefits are more fully appreciated through the following information. The elastomer composition of the invention has three classes of additives: (I) process aids, (II) binders, and (III) performance enhancers. The following are weight percentage ranges and preferable values for each of the additives.

| | Weight % Range | Preferable Weight % |
|---|---|---|
| I. Process Aids | | |
| A. Water | 7–9 | 8 |
| B. Disperant | 0.3–0.5 | 0.4 |
| C. Hydrophilic Clay | 6.5–8.5 | 7.5 |
| D. Ion Adjuster | 0.8–.12 | 0.1 |

-continued

| | Weight % Range | Preferable Weight % |
|---|---|---|
| E. Inert Filler | 10–14 | 12 |
| F. Congealer | 0.4–0.6 | 0.5 |
| G. Dryer | 0.8–1.2 | 1.0 |
| H. Anti-Foam | 0.4–0.6 | 0.5 |
| II. Binders | | |
| A. Thermoset Resin | 10–13 | 11.5 |
| B. Thermoplastic Resin | 31–39 | 35 |
| III. Performance Enhancers | | |
| A. Flame Retardant | 18–22 | 20 |
| B. Fungicide | 0.4–0.6 | 0.5 |
| C. Bubble Breakers | 1.8–2.2 | 2.0 |
| D. Rheology Control | 0.8–1.2 | 1.0 |

These materials may be obtained as the following products from the following companies.

| Item | Product Name | Company, Location |
|---|---|---|
| I. | | |
| A. | Generic | Generic |
| B. | Dysperbec | Byk Chemie, Wallingford, Connecticut |
| C. | Bentonite | Beroid Drilling Fluids Helena, Montana |
| D. | Glacial Acetic Acid | Generic |
| | Sodium Hydroxide | Generic |
| E. | Calcium Carbonate | Pleuss-Staufer Los Angeles, California |
| F. | Butyl Cellusolve | Generic |
| G. | Kwik Dri | Ashland Newark, California |
| H. | NXZ | Henkle Kankakee, Illinois |
| II. | | |
| A. | Rholplex 1791 | Rohm & Haas Hayward, California |
| B. | Emulsified Asphalt | Conoco Elk Grove, California |
| III. | | |
| A. | Aluminum Trihydrate | Alcoa Los Angeles, California |
| B. | Formaldehyde | Generic |
| C. | SWS 211 | Wacker Silicones Adrian, Michigan |
| | Sufanol 104 | Air Products, Inc. Allentown, Pennsylvania |
| D. | SCT270 | Rohm & Haas |

There are several important features to be noted regarding the elastomer composition of the invention. First, in reference to the binders, note that the weight percentage of the binder resins in the liquid phase is preferably approximately 46.5 of the total recipe weight. However, upon curing of the elastomer, the binders (remaining solids) constitute between 40 and 42 weight percentage, preferably approximately 40 weight percentage of the cured composition. This preferable 40% neat polymer value facilitates compliance with all relevant building codes. This relatively high liquid phase binder solids content generally results in high recipe viscosities and thus problems when spraying the elastomer. To overcome the viscosity problem, maintain high solids content in the liquid recipe, and maintain adequate binder performance in the cured state, care must be taken in preparation of the binder resin. Thus, in accordance with the invention, the thermoplastic resin (II,B) is preferably formed with solid particles that are less than or equal to 0.5 microns in size. The thermoset resin (II,A) is preferably formed with solid particles that are less than or equal to 0.1 microns in size.

An additional feature of the resin component of the elastomer composition that is noteworthy is that the binder resins, in combination with the hydrophilic clay, constitute a mixture that, under the shearing action of the application pumping equipment, experiences a substantial reduction in viscosity. This thixotropic characteristic, together with other viscosity parameters, are discussed below.

An additional feature of the elastomer composition that is noteworthy is the fact that it includes both an anti-foam compound (I,H) and multiple bubble breaker compounds (III,C). As will be discussed below, this feature of the elastomer composition alleviates the air entrainment problem associated with injecting a resin through a pre-installed scrim, while eliminating the voids associated with the prior art.

Attention now turns to the scrim used in conjunction with the invention. FIG. 1 is a plan view of a scrim 20. The scrim 20 includes machine-directional strands 22 and cross-directional strands 24. Preferably, the machine-directional strands 22 each have a width (left-to-right in FIG. 1) of between 0.005 and 0.025 inches, preferably approximately 0.020 inches, and depth (direction into FIG. 1) of between 0.003 and 0.005 inches, preferably approximately 0.004 inches. In a preferable embodiment, there are between 7 and 11 strands per linear inch, preferably approximately 9 strands per linear inch. The preferable machine direction grab strength per linear inch is between 120 and 160 pounds, preferably approximately 140 pounds.

The cross-directional strands 24 each have a width (top-to-bottom in FIG. 1) of between 0.030 and 0.070 inches, preferably approximately 0.050 inches, and depth (direction into FIG. 1) of approximately 0.001 inches. In a preferable embodiment, there are between 7 and 11 strands 24 per linear inch, preferably approximately 9 strands per linear inch. The preferable machine direction grab strength per linear inch is between 110 and 150 pounds, preferably approximately 130 pounds.

The X-direction aperture 26 within the matrix of the scrim 20 is preferably between 0.060 and 0.10 inches, preferably approximately 0.080 inches. The Y-direction aperture 28 within the matrix of the scrim 20 is between 0.035 and 0.075 inches, preferably approximately 0.055 inches.

In one embodiment, the scrim has a total width (cross-directional dimension) of between 40 to 62 inches and a total length (machine-direction) of approximately 600 feet. The weight per yard is preferably between 2 and 6 ounces, preferably approximately 4 ounces. This relatively light weight reduces dead weight building structural loadings.

Figure 2:
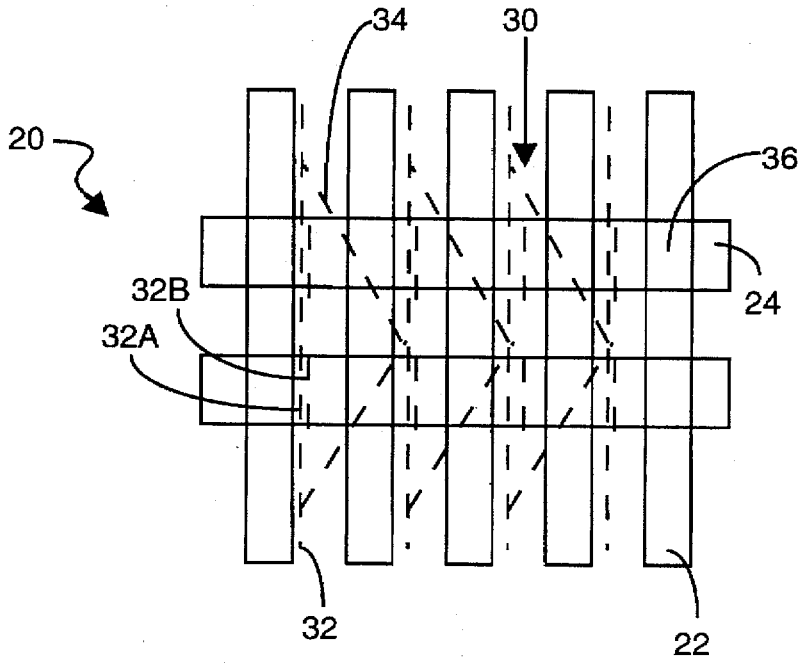
FIG. 2 is a plan view of a reinforcement textile, along with structural support stitching, which may be used in accordance with the invention.

The machine-directional strands 22 and cross-directional strands 24 may be formed of spin-finish acrylic coated polyester fibers. The strands need not be woven together. FIG. 2 illustrates that the strands 22 and 24 may be mechanically bound with a light weight thread 30, for instance formed of polyester. The thread 30 includes machine-directional segments 32 that may be simultaneously woven above 32A and beneath 32B the cross-directional strands 24. The thread 30 may also include zig-zag segments 34 that are linked to adjacent machine-directional segments 32, as shown in FIG. 2.

It is important to note that the disclosed scrim 20 is stable for handling, but is supple enough to articulate over an irregular roofing substrate. These characteristics may be quantified by providing a scrim 20 that, when allowed to drape over an edge, forms a 90° angle within a half-inch of the edge. In addition, the scrim 20 should have enough flexibility that at each intersection 36 of strands 22 and 24, 20 grams of force displaces at least one of the strands. In other words, the force necessary to displace a machine-directional strand 22 or a cross-directional strand 24 at an intersection 36 should be no greater than 20 grams, where the force is applied in the plane of the scrim at a point parallel to one strand and at a right angle to the other.

The disclosed scrim 20 meets these constraints. The disclosed scrim 20 is manufactured by Milliken & Company, Lagrange, Ga., as ECOSTAR Systems, Inc. part number P-375.

Related scrim configurations within the scope of the disclosed invention may also be used. For example, the strands 22 and 24 may be formed of any material that will independently, or after coating with a sizing substance, bond to the waterproofing elastomer. For instance, an aqueous thermosetting, carboxylated, butyl acrylic may be used. The complete membrane should provide a nominal tensile strength of 200 pounds per linear foot. An adhesive, in lieu of mechanical stitching or weaving, may be used at each intersection 36.

The scrim 20 may be spooled onto a cardboard tube. When installing an adhered roofing membrane in accordance with the invention, the scrim 20 is rolled onto a roofing substrate such that the machine-directional strands 22 are in direct contact with the roofing substrate. This means that the cross-directional strands 24 are raised above the roofing substrate.

Figure 3:
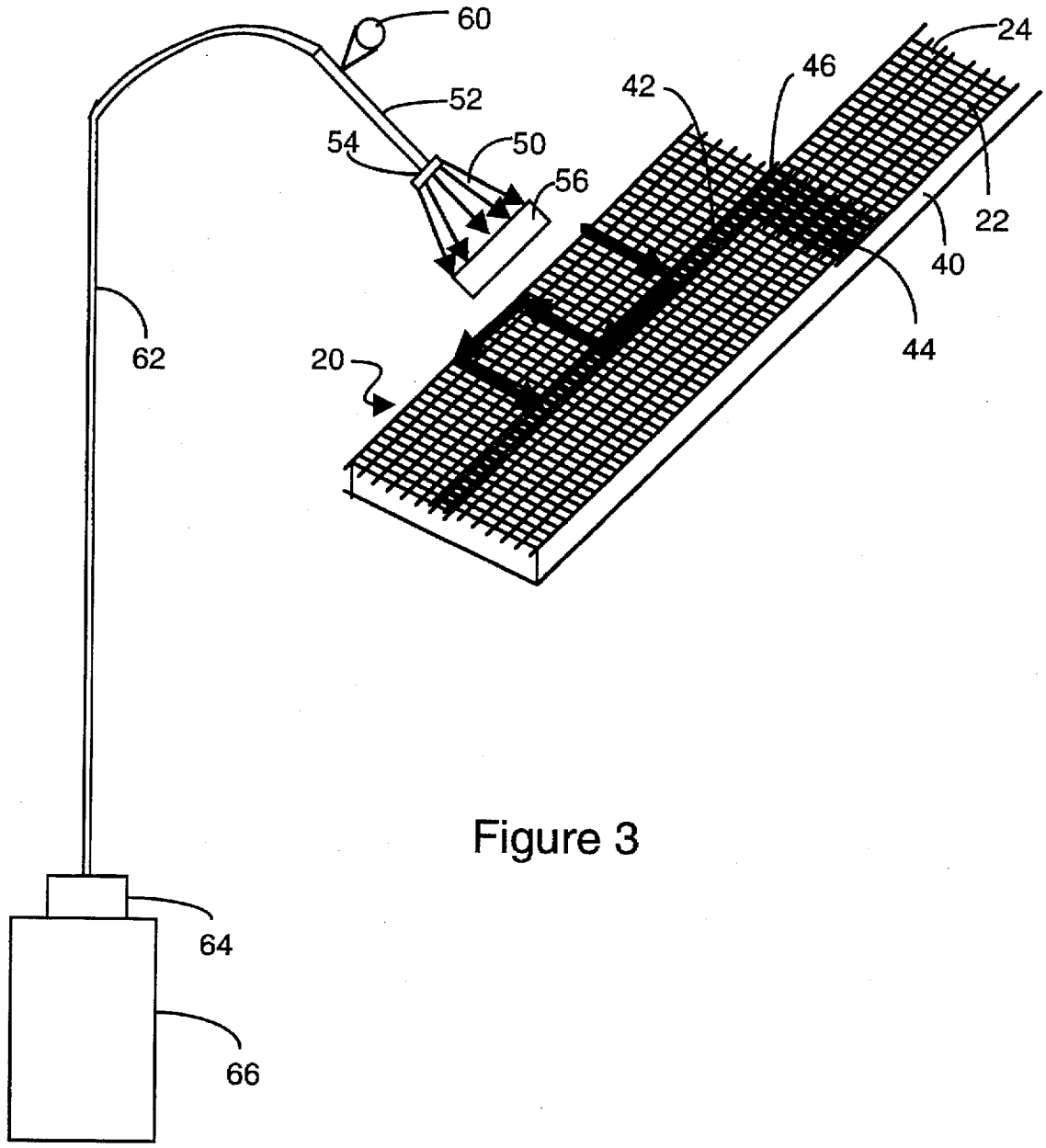
FIG. 3 is a perspective view illustrating the application of an elastomer to a pre-installed reinforcement textile, consistent with the teachings of the invention.

FIG. 3 illustrates a scrim 20 rolled onto a roofing substrate 40. Typically, the roofing substrate 40 will be metal, insulation panels, or some other previously installed roofing material, such as built-up asphalt, or rubberized sheet goods. The roofing substrate 40 should be clear and dry.

The scrim 20 is dry rolled, usually in one continuous strip, the full length or width of the roofing substrate 40. Thereafter, an additional strip of scrim 20 is rolled out such that it overlaps the previously installed strip, preferably by between two and six inches, preferably approximately four inches. The overlap area, called a selvedge 42, is shown in FIG. 3. Whenever the scrim roll runs out, a new roll begins by overlapping the end of the previous roll, preferably between six and ten inches, preferably approximately eight inches. This area is called a head lap 44. The region where the headlap 44 and selvedge 42 coincide is called a "T" lap 46. Conventional techniques may be used to cut the scrim 20 to accommodate obstacles on the roofing substrate, such as vents.

After the scrim 20 has been pre-installed on the roofing substrate 40, the previously described elastomer composition is sprayed onto the scrim. FIG. 3 illustrates a wand 52 with a spray tip 54 delivering elastomer composition 50. Preferably, the spray tip 54 is configured to produce a 65° fan angle (32.5° angle to the left of the center line of the wand 52 and 32.5° angle to the right of the center line of the wand 52). Preferably, the spray tip 54 is held between 14 and 28 inches, preferably about 24 inches, above the roof substrate 40. This results in a spray footprint 56 of approximately 3 inches by 36 inches.

As shown in FIG. 3, preferably, the length of the spray footprint 56 is parallel to the machine-directional strands 22. The spray technician walks from side to side covering about 36 inches of scrim 20 then backs up before returning with subsequent applications. Thereby forming a pattern similar to a square sine wave, as shown with the thick arrows of FIG. 3.

It is important to keep the wand tip 54 directly over the scrim 20 so that the applied elastomer 50 strikes the scrim in a substantially perpendicular manner. That is, the applied elastomer 50 should be directed straight down upon the scrim 20. If the deviation from this perpendicular orientation is more than 15°, then there is a problematic loss of impact velocity at the prescribed application pressure, which effects elastomer-scrim interactions. If the elastomer is applied with an orientation greater than 15°, then it is not considered to be applied in a substantially perpendicular manner, as defined herein. The tendency toward deviation from perpendicular elastomer application commonly arises at the selvedge 42 regions of the scrim.

The rate of movement back and forth between the borders of the width of the scrim is performed at a rate which assures that nearly all the openings in the scrim 20 have been filled and that simultaneously the top of the scrim 20 is covered with an even coat of material.

Existing roof surface irregularities may range from a smooth insulation panel face, with less than 1/16 inch variation, up to 3/8 inch or more where installation takes place over a previous rock surfaced membrane. Generally, a minimum spread rate of five gallons of elastomer per one hundred square feet is required to fully embed and cover the scrim. The scrim is typically covered after two or three passes with the wand 52. This spread rate yields a wet elastomer thickness of approximately 0.080 inches. Few roof surface substrates are perfectly smooth, thus an average wet elastomer thickness of between 0.090 inches to 0.100 inches is common. Upon curing, approximately 30% of the wet elastomer volume is lost. Thus, in the case of a wet elastomer thickness of approximately 0.080 inches, the cured elastomer thickness is approximately 0.060 inches (60 mils).

The wand 52 preferably includes a pressure gauge 60. The wand 52 is connected to a hose 62 that is connected to a pump 64. The pump 64 forces the elastomer contents from a drum 66. Typically, the drum 66 is positioned on the ground, instead of on the roofing substrate 40. As previously indicated, the elastomer has been formulated to a high solids state, possessing up to 70% non-volatile content. The static in-the-drum viscosity must be above 3000 centipoise to assure that the solids remain in a homogenous and fully suspended condition, thereby requiring little or no remixing after shelf storage.

To achieve a successful injection delivery of the elastomer through the openings in the scrim 20, within the limits of conventionally available pumping equipment, an important bulk property of the elastomer must be a tendency toward thixotropism under the shearing stresses caused by the pump mechanism. The delivered elastomer viscosity at the spray tip 54 should be no more than approximately 800 centipoise. At or below this viscosity, a minimum tip pressure should be approximately 300 psi. A suitable tip pressure range is between 250 and 500 psi.

As the distance and height of the roofing membrane installation increase relative to the pump 64, an increasingly more powerful pumping capability and larger hose diameter is required to maintain critical minimum pressure at the injection point. Dropping below this minimum tip pressure will result in dry spots beneath and between the scrim 20 and underlying roof substrate 40. These dry spots, or voids will result in blistering under the sun's radiant energy, usually within just a few hours after the surrounding membrane has reached initial cure. The selvedge 42 and "T" lap areas 46 of the scrim 20 installation, where the elastomer must be driven through two and three layers of scrim 20 respectively, are particularly vulnerable to being not fully injected and therefore the operator is trained to be very deliberate in application technique with the high velocity elastomer flow over these areas.

While a pressure gauge located on the pump 64 may be useful for the operator to gain a general sense of what the wand pressure should be, variations which may occur within the work environment such as: pockets of higher viscosity elastomer within the barrel 66, film build-up at various points within the hose 62, wear induced low pressure "blips" within the pump stroke of the pump 64, elevation changes by the operator at various points during the application effort may all result in too low a pressure actually being delivered to the application wand tip 54. Therefore, the litmus test for assuring adequate injection velocities must be a properly operating wand mounted pressure gauge 60. The pressure gauge 60, possessing a large, easily readable face, is positioned so that the operator may constantly check the wand pressure for the 300 psi critical minimum value. Should the pressure drop below this minimum, the pressure regulator at the pump 64 should be modified.

In view of the parameters set forth above, between 20–60% of the applied elastomer will be driven between the lower surface of the scrim 20 and the roofing substrate 40. As the elastomer is ejected from the spray tip 54, it begins to mix with air. As it is driven through the openings of the scrim 20 and beneath the principally wider cross-directional fibers 24, further air entrainment is achieved. At or below approximately 7,000 feet elevation above sea level, the injected elastomer beneath the scrim 20 is at least 15%, by volume, entrained air, with a reasonably uniform distribution pattern.

The previously described bubble breaker components within the elastomer are activated by this gas phase such that immediately upon arrival beneath the scrim 20, the air within the elastomer matrix, then possessing a slightly higher pressure than ambient atmospheric pressure, begins to expand and rise. The rising bubbles, pressing on the underside of principally the relatively wide, cross-directional scrim strands 24, cause the scrim to be displaced upward. As the air bubbles rise, they most frequently exit to one side of the cross-direction scrim strands 24, rather than both sides simultaneously.

The scrim design allows the machine-directional strands 22 and the cross-directional strands 24 to operate independently. Consequently, an axial rotation of the cross-directional strand occurs such that as the air bubbles leave the elastomer, the resultant void is immediately filled with the surrounding higher density elastomer. To some extent, the molecular tension of the elastomer components resist the movement of the scrim 20. The balance struck between these opposing forces causes a predictable centering and embedment of the scrim 20. The scrim 20 is typically centered between 15 and 65% of the mean average thickness of the applied elastomer.

The previously described articulating fiber structure of the scrim 20 allows the scrim to closely conform to the irregularities typically found on roof substrates such as bumps and crevices. When the elastomer is injected, the fiber is easily displaced into and around these irregularities such that the elastomer/scrim matrix hugs, in a wet condition, most irregularities with about the same overall cross-section as is obtained on a level, smooth surface.

Where the initial injection process may not have been sufficient to fill the void beneath unusually pronounced scrim excursions over dimensionally large and pronounced irregularities, the elastomer which did not enter the chamber around the irregularity simply falls to the lowest point, leaving an obvious, visually identifiable opening in the scrim surface. This opening may be re-injected with additional elastomer.

Upon curing, as the volatile component flashes off and the elastomer contracts, the supple scrim is sucked down around even the smallest protrusion or divot on the roofing substrate 40. This process constitutes a type of shrink-wrap phenomena. The resultant roofing membrane formed by the scrim and cured resin hugs all roofing substrate contours without the use of excessive amounts of elastomer; and provides improved resistance to loadings such as puncture, tear, and compression insults. The shrink-wrap phenomena also allows for a uniform membrane thickness, providing consistent high tensile properties throughout the roofing membrane.

After the disclosed roofing membrane of the invention is installed and cures, a protective coating may be placed on it to reduce ultraviolet degradation. Any type of protective coating known in the art may be used, such as paint, a reflective coating, and granulars.

The benefits of the invention will be readily appreciated by those skilled in the art. It is relatively easy to install a scrim before an elastomer is applied. Applying the elastomer of the invention after the scrim has been installed allows visual feedback regarding the amount of elastomer coverage. If insufficient elastomer has been applied, the scrim appears through the elastomer coating, providing a visual indication to the spray technician that more elastomer is required. This type of information allows a technician with limited training to use the process of the invention. This information also substantially reduces the possibility of latent defects that result in long term, persistent maintenance problems and property damage.

The process of the invention uses a relatively high solids content elastomer with a sufficiently low application viscosity to permit proper interaction with the pre-installed scrim. The recipe chemistry of the elastomer also produces an acceptable centering of the scrim within the final adhered roofing membrane. The disclosed elastomer also solves the air entrainment problem that would otherwise prevent utilization of this technology.

The disclosed elastomer and resultant roofing membrane is energy efficient, environmentally benign, and complies with all building standards.

The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following Claims and their equivalents.

I claim:

1. A method of installing an impervious roofing membrane barrier onto a roof substrate, said method comprising the steps of:

applying a reinforcement textile to said roof substrate; and spraying an elastomer composition on said reinforcement textile such that said elastomer composition lifts said reinforcement textile from said roof substrate and embeds said reinforcement textile within said elastomer composition in response to said spraying step, wherein said spraying step includes the step of using an elastomer composition with an anti-foamant and a bubble breaker.

2. The method of claim 1 wherein said applying step includes the step of using a reinforcement textile with machine directional strand widths between 0.005 and 0.025 inches.

3. The method of claim 1 wherein said applying step includes the step of using a reinforcement textile with cross-directional strand widths between 0.030 and 0.070 inches.

4. The method of claim 1 wherein said applying step includes the step of using a reinforcement textile that has between 7 and 11 cross-directional strands and between 7 and 11 machine-directional strands per linear inch.

5. The method of claim 1 wherein said applying step includes the step of using a reinforcement textile that has between 0.025 and 0.075 inches between parallel and adjacent cross-directional strands and between parallel and adjacent machine-directional strands.

6. The method of claim 1 wherein said applying step includes the step of using a reinforcement textile that has a weight per square yard of between 2 and 6 ounces.

7. A method of installing an impervious roofing membrane barrier onto a roof substrate, said method comprising the steps of:

applying a reinforcement textile to said roof substrate, said reinforcement textile including machine-directional strands and cross-directional strands that cross at intersection points and form a matrix, wherein said applying step includes the step of using a reinforcement textile with a cross-directional grab tensile strength and a machine-directional grab tensile strength of between 110 and 150 pounds per linear inch; and spraying an elastomer composition on said reinforcement textile such that said elastomer composition lifts said reinforcement textile from said roof substrate and embeds said reinforcement textile within said elastomer composition in response to said spraying step.

8. The method of claim 1 wherein said spraying step includes the step of using a spray wand that applies said elastomer composition at a pressure of approximately 300 pounds per square inch.

9. A method of installing an impervious roofing membrane barrier onto a roof substrate, said method comprising the steps of:

applying a reinforcement textile to said roof substrate; and spraying an elastomer composition on said reinforcement textile such that said elastomer composition lifts said reinforcement textile from said roof substrate and embeds said reinforcement textile within said elastomer composition in response to said spraying step, wherein said spraying step includes the step of using an elastomer composition with thermoset resin with particle sizes less than or equal to 0.1 microns and thermoplastic resin with particle sizes less than or equal to 0.5 microns.

10. The method of claim 9 wherein said spraying step includes the step of storing said elastomer composition in a drum with in-drum viscosity greater than 3000 centipoise.

* * * * *